US007980968B1

(12) United States Patent
Erik Bernard

(10) Patent No.: US 7,980,968 B1
(45) Date of Patent: Jul. 19, 2011

(54) STRINGING DEVICE OF A RACKET STRINGING MACHINE

(75) Inventor: Van Der Pols Erik Bernard, Taichung Hsien (TW)

(73) Assignee: Elding Ind. Co., Ltd., Taichung Hsien (TW)

( * ) Notice: Subject to any disclaimer, the term of this patent is extended or adjusted under 35 U.S.C. 154(b) by 0 days.

(21) Appl. No.: 12/817,816

(22) Filed: Jun. 17, 2010

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS 4,376,535 A * 3/1983 Muselet et al. ..... 473/556
4,417,729 A * 11/1983 Morrone ..... 473/556
4,620,705 A 11/1986 Tsuchida
5,733,212 A 3/1998 Wise et al.
6,227,990 B1 5/2001 Wise et al.
6,583,590 B1 * 6/2003 Chu ..... 318/34
6,837,811 B1 * 1/2005 Wu ..... 473/557
7,153,226 B1 * 12/2006 Van Der Pols ..... 473/557
7,192,370 B2 * 3/2007 van der Pols ..... 473/557
7,686,713 B2 * 3/2010 Severa et al. ..... 473/557
7,695,383 B2 * 4/2010 Severa et al. ..... 473/557
7,833,118 B2 * 11/2010 Severa et al. ..... 473/557
2003/0027670 A1 * 2/2003 van der Pols ..... 473/557

* cited by examiner

*Primary Examiner* — Raleigh W. Chiu
(74) *Attorney, Agent, or Firm* — Wang Law Firm, Inc.; Li K. Wang

(57) ABSTRACT

A stringing device of a racket stringing machine includes a shell whose internal surrounding surface is defined with a track extending along a straight line; a sliding base accommodated in the track of the shell, with wheels on its opposite sides to roll on the surrounding surface of the track; a stringing head fixed on the sliding base by its bottom end; a transmission mechanism connected to the sliding base to drive the sliding base to slide along the track, concurrently driving the stringing head on the sliding base to move along a straight line.

8 Claims, 7 Drawing Sheets

STRINGING DEVICE OF A RACKET STRINGING MACHINE

BACKGROUND OF THE INVENTION

1. Field of Invention

The invention relates to a racket stringing machine structure and, in particular, to a stringing device of a racket stringing machine.

2. Related Art

As shown in FIG. 7, the stringing device of a racket stringing machine in the prior art has the following structure. A stringing head 72 is disposed on the top surface of a sliding base 71. The sliding base 71 is mounted on two guiding rails 73 in parallel. The sliding base 71 is connected with a chain 75 winding around two gears 74. A driving motor 76 drives one of the gears 74 to pull the chain 75, thereby pulling the sliding base 71 to move in a straight line along the guiding rails 73.

In the above-mentioned stringing device of a racket stringing machine, the sliding base 71 slides on the guiding rails to pull a string. To ensure the smoothness of the sliding base 71 as it slides, it usually requires high precision between the sliding base 71 and the guiding rails 73. Since there is a certain string-pulling distance, the guiding rails 73 have to a sufficient length. This renders the precision control even more difficult, thus increasing the production cost. Moreover, in addition to the transmission structure for pulling the sliding base 71, the stringing device further has the structure of guiding rails that go through the sliding base 71. Such a structure makes the size of the stringing device larger.

To reduce the production cost, U.S. Pat. Nos. 4,620,705, 5,733,212, and 6,227,990 proposed to use a screw bar to drive the sliding base installed with a stringing head structure. However, in these patents, as the screw bar drives the sliding base, the force to pull the string may tilt the sliding base relative to the screw bar. Therefore, the screw bar can be easily deformed or worn out too quickly.

SUMMARY OF THE INVENTION

An objective of the invention is to provide a stringing device of a racket stringing machine that has a cheap production cost and ensures the smoothness in pulling the string at the same time.

To achieve the above objective, the disclosed stringing device of a racket stringing machine includes: a shell, a sliding base, a stringing head, and a transmission mechanism.

The shell is hollow, with its internal surrounding surface formed with a track extending along a straight line.

The sliding base is disposed in the track of the shell. The two opposites sides of the sliding base are provided with wheels to roll on the surrounding surface of the track.

The stringing head is extended downward with a strain gauge support. The stringing head is then fixed onto the sliding base by the bottom end of the strain gauge support. The stringing head are exposed from the top surface of the shell.

The transmission mechanism is connected with the sliding base for driving the sliding base to slide along the track. It concurrently drives the stringing head on the sliding base to move along a straight line.

The sliding base is formed in the radial direction with a through hole on each of the four corners of its side surfaces. Each through hole is inserted with a wheel axis whose outer diameter is slightly smaller than the diameter of the through hole. Both ends of each of the wheel axes are mounted with wheels. Two elastic urging elements are interposed between each two wheels opposite in the vertical direction. The two elastic urging elements urge against the two ends of the corresponding wheel axis near the associated wheel. The urging force of the two elastic urging elements pushes the wheels opposite in the vertical direction to slide on the top surface and bottom surface of the track.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

Figure 1:
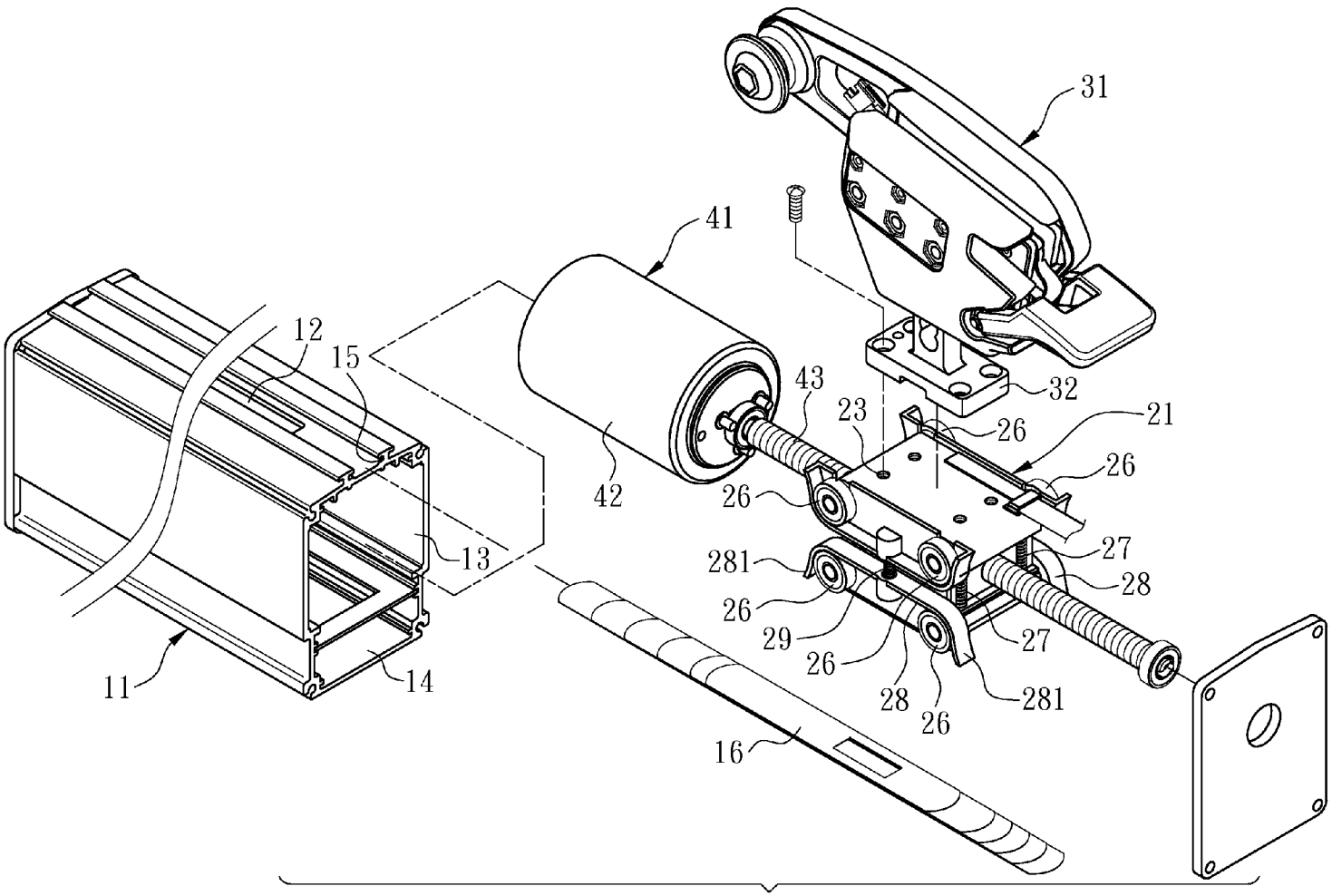
FIG. 1 is an exploded view of the invention.
Figure 2:
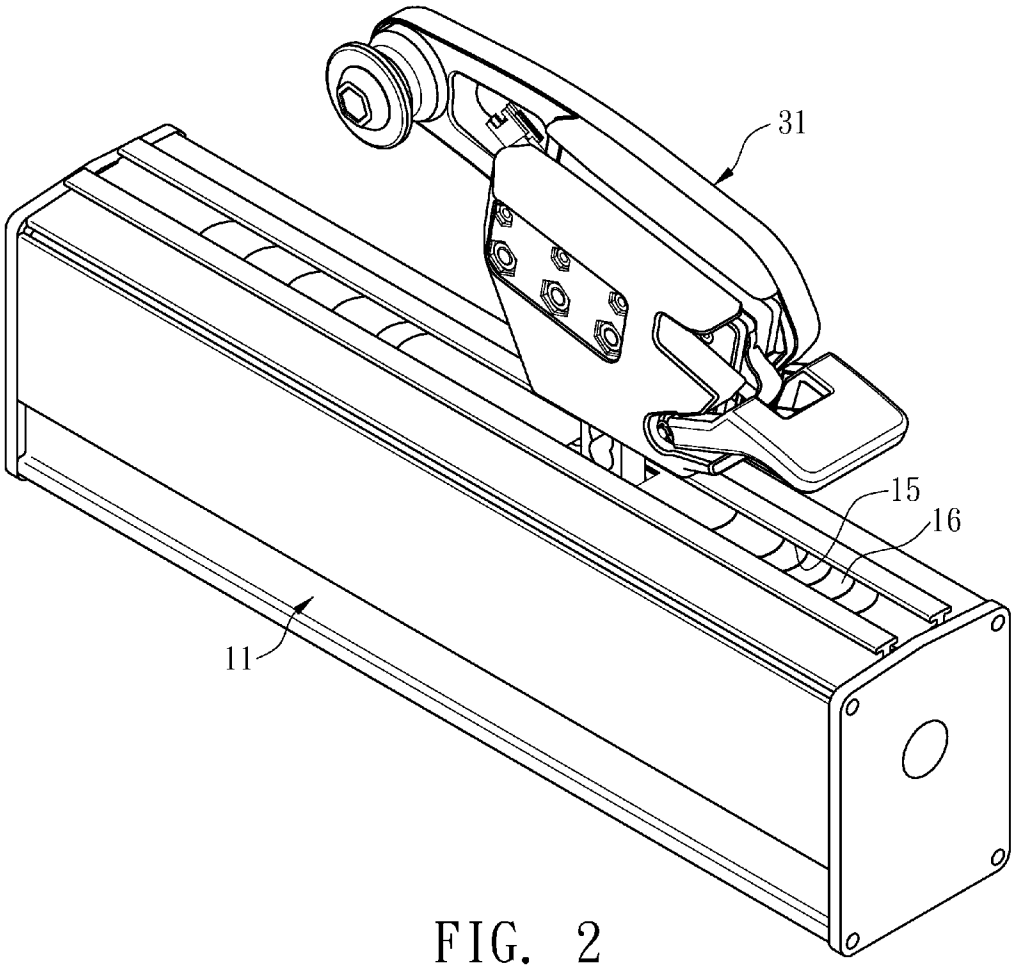
FIG. 2 is a three-dimensional perspective view of the invention after assembly.
Figure 3:
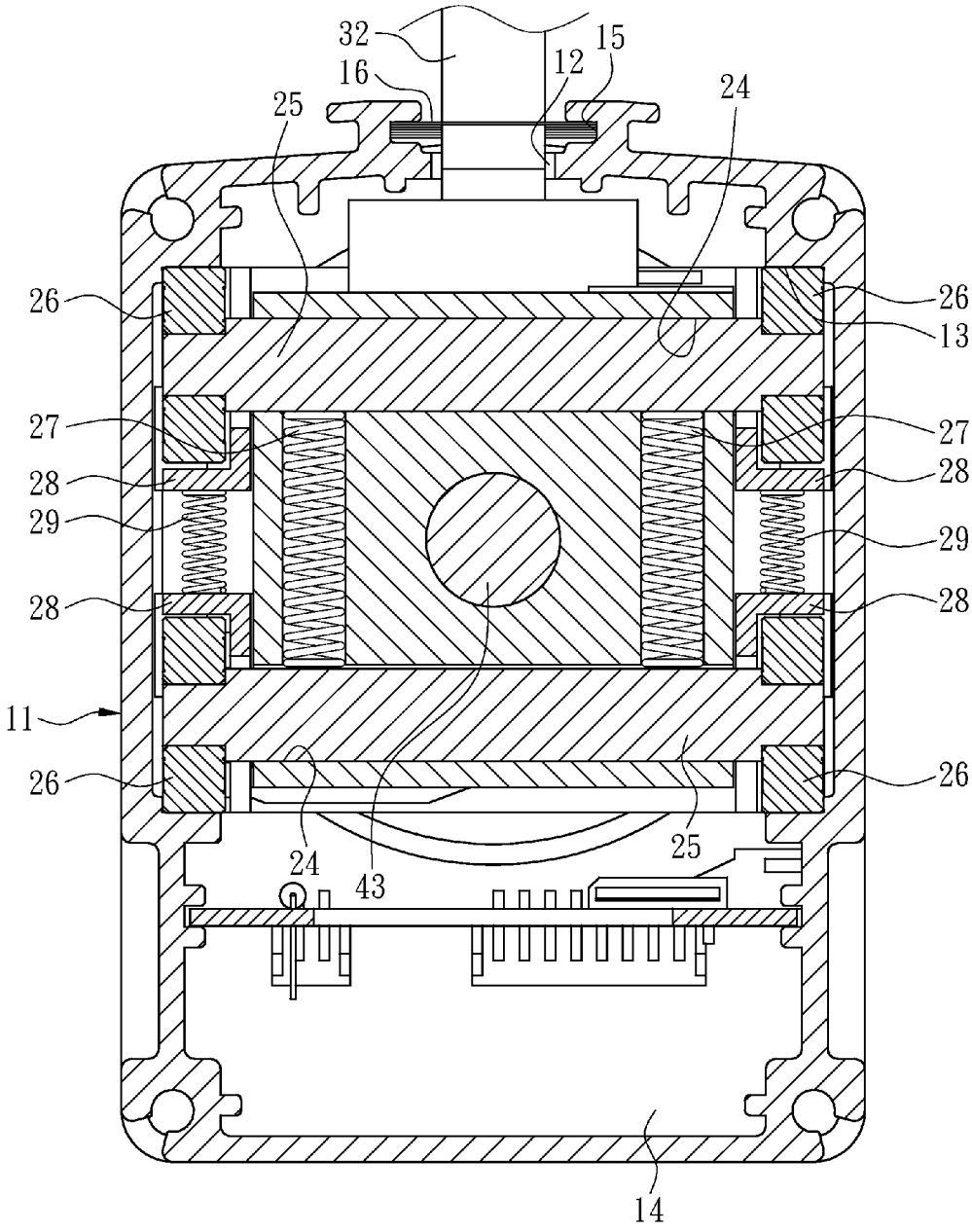
FIG. 3 is a cross-sectional view of the invention after assembly.
Figure 4:
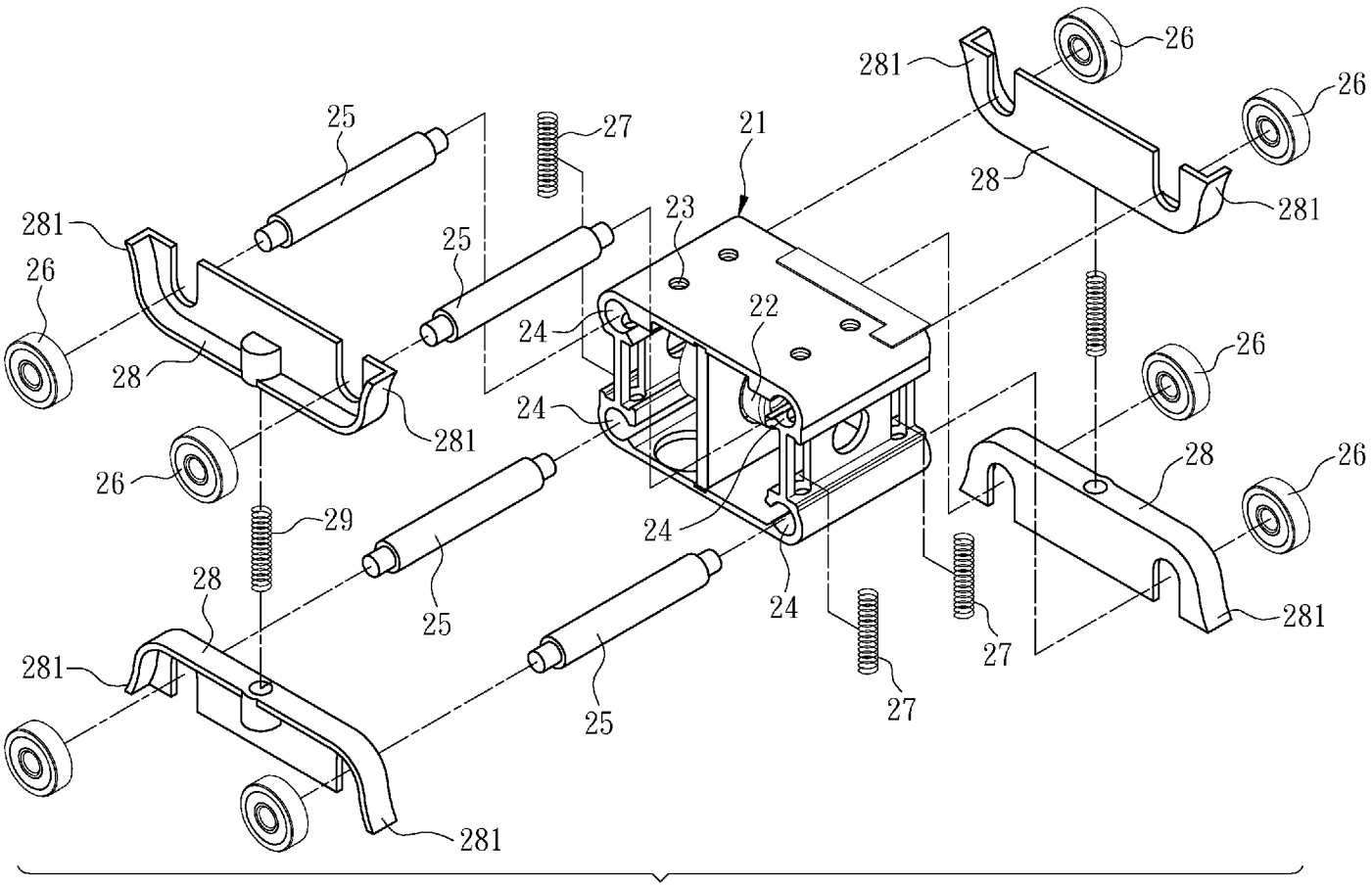
FIG. 4 is a detailed exploded view of invention.

The present invention will be apparent from the following detailed description, which proceeds with reference to the accompanying drawings, wherein the same references relate to the same elements.

Please refer to FIGS. 1 to 4 for the stringing device of a racket stringing machine according to the invention. The stringing device includes: a shell 11, a sliding base 21, a stringing head 31, and a transmission mechanism 41.

The shell 11 is a hollow square tube integrally formed by aluminum extrusion. The top surface of the shell 11 is provided with a long groove 12 extending along a straight line. The four corners on the inner surrounding surface of the shell 11 is defined with a track 13 extending along the same direction as the long groove 12. The lower part opposite to the track 13 of the shell 11 is extended with an accommodating space 14 in connection with the track 13. Each side along the longitudinal direction of the long groove 12 is protruded upward with an engaging groove 15, in which a sliding cover 16 slides.

The sliding base 21 is disposed in the track 13 of the shell 11. Please refer to FIG. 4. In this embodiment, the inside of the sliding base 21 has a screw connection element 22. The top surface of the sliding base 21 has several screw holes 23. Each of the four corners on the side surface of the sliding base 21 is formed with a through hole 23 in the radial direction. Each of the through holes 24 is inserted with a wheel axis 25 whose outer diameter is slightly smaller than the diameter of the through hole 24. Both ends of the wheel axis 25 exposed from the through hole 24 are mounted with a wheel 26, respectively. Two elastic urging elements 27 are interposed between the two wheel axes 25 opposite in the vertical direction. The two elastic urging elements 27 urge against the two ends of each wheel axis 25 near the wheels 26. The urging force of the two elastic urging elements 27 ensures that the wheels 26 opposite in the vertical direction slide on the top surface and the bottom surface of the track 13, respectively. The two side surfaces of the sliding base 21 with the wheels 26 are provided two scratching boards 28, one on the upper side and the other on the lower side. Each of the scratching boards 28 is provided around the wheels 26 opposite in the horizontal direction. Both ends of each scratching board 28 extend toward the opposite surrounding surface to form an urging section 281. An elastic element 29 is interposed between the two scratching boards 28 on the same side surface of the sliding base 21. The elastic element 29 pushes the urging section 281 of each of the two scratching boards 28 to urge against the top surface and the bottom surface of the track 13 for the wheels 26.

The stringing head 31 is extended downward with a strain gauge support 32. The stringing head 31 is then locked into the positioning hole 24 on the top surface of the sliding base 21 through the bottom end of the strain gauge support 32. The stringing head 31 is exposed from the top surface of the shell 11.

The transmission mechanism 41 is connected with the sliding base 21 for driving the sliding base 21 to slide along the track 13. It concurrently drives the stringing head 31 on the sliding base 21 to move along a straight line. In this embodiment, the transmission mechanism 41 is disposed in the track 13 of the shell 11. The transmission mechanism 41 consists of a motor 42 and a guiding screw bar 43 driven by the motor 42. Moreover, the guiding screw bar 43 screws into the screw connection element 22 in the sliding base 21. When the motor 42 drives the guiding screw bar 43, the sliding base 21 is driven by the guiding screw bar 43 and restricted by the track 13 to move in the designated straight line.

Figure 5:
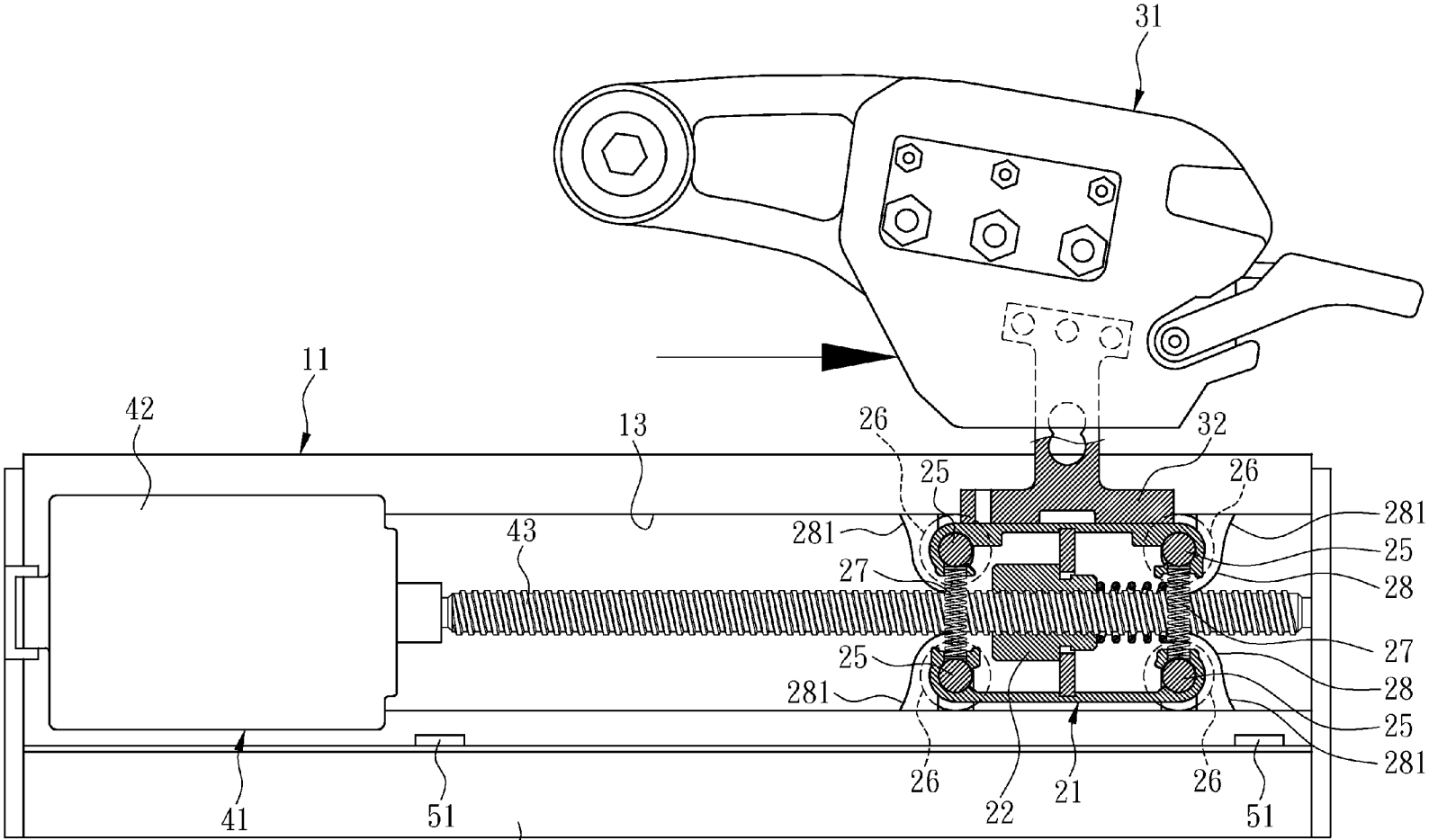
FIG. 5 is a schematic view of the invention in use.

Please refer to FIG. 5. In practice, the wheels 26 on the sliding base 21 slide firmly on the top surface and bottom surface of the track 13 as the elastic urging elements push the wheel axes 25. Therefore, when the transmission mechanism 41 drives the sliding base 21 to slide along the track 13, the sliding base 21 can move along a straight line smoothly. Furthermore, the scratching boards 28 are provided around the wheels 26 opposite in the horizontal direction. When the sliding base 21 is driven by the transmission mechanism 41 to move in a straight line, the urging section 281 of each of the scratching boards 28 can remove dusts on the top surface and the bottom surface of the track. This action further ensures the smoothness of the motion of the sliding base on the track 13.

The accommodating space 14 under the track 13 accommodates a circuit for driving the stringing device. Both ends of the sliding stroke of the sliding base 21 on the shell 11 are provided with a reed switch 51, respectively. Predetermined positions on the sliding base 21 are then provided with two controlling units (not shown) to correspondingly start the two reed switches 51. When starting the reed switches 51, a reverse signal is transmitted to the transmission mechanism 41, making the sliding base 21 to slide back and forth between the two ends of the stroke.

Figure 6:
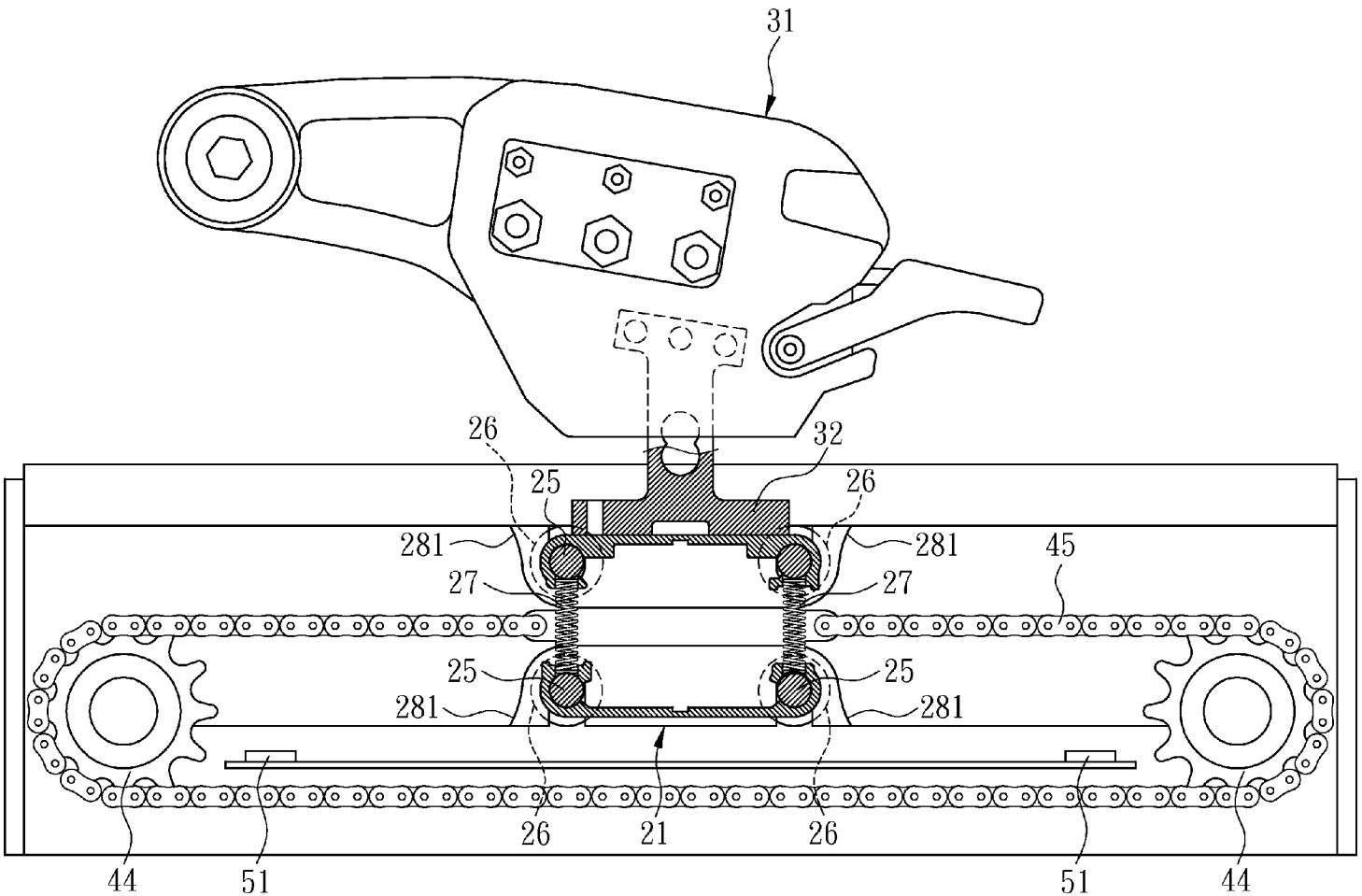
FIG. 6 is a schematic view of the second embodiment according to the invention.
Figure 7:
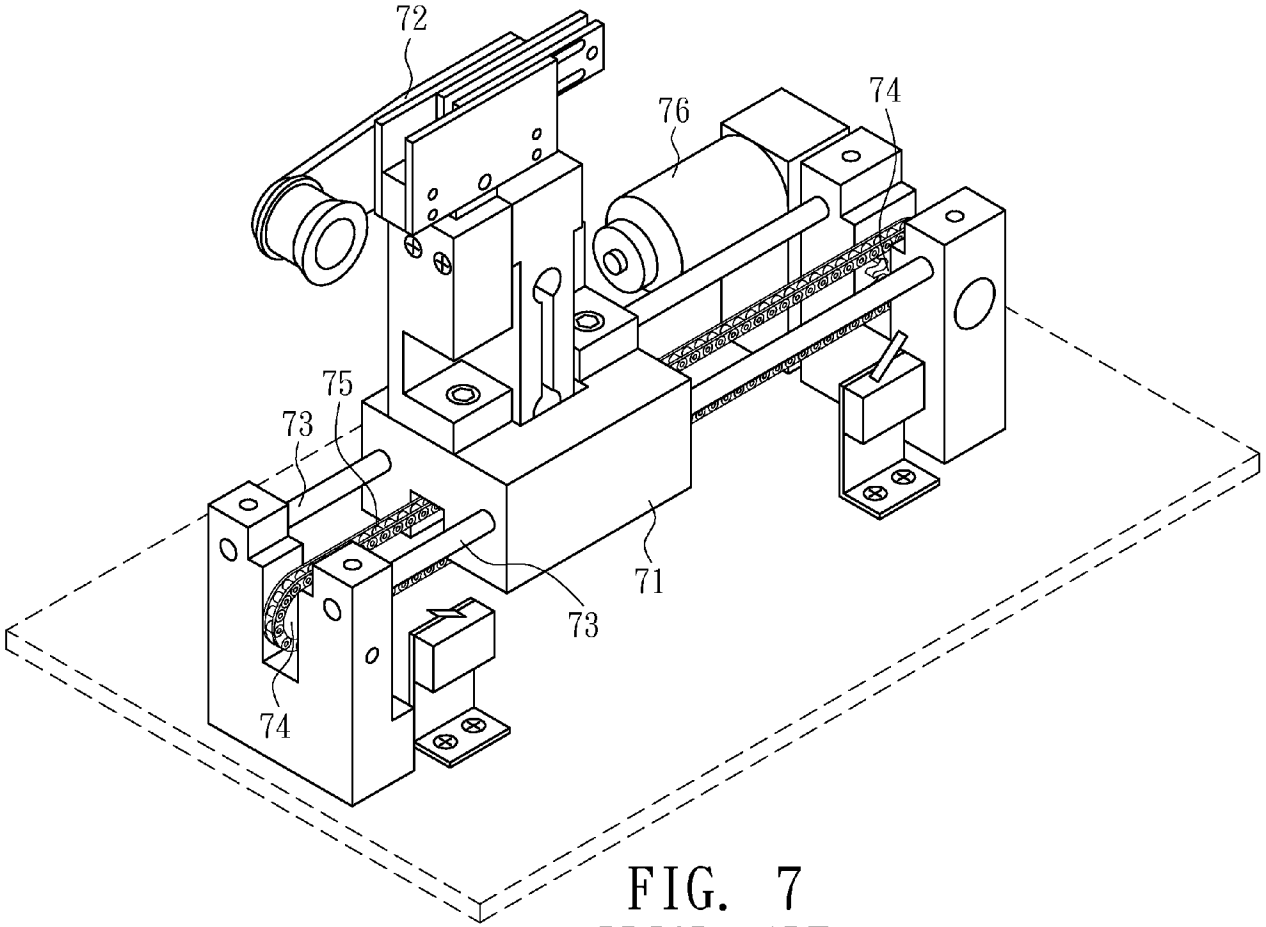
FIG. 7 PRIOR ART
FIG. 7 is a schematic view showing the structure of stringing device of a racket stringing machine in the prior art.

FIG. 6 shows a second embodiment of the invention. It differs from the previous embodiment in that the transmission mechanism 41 consists of two gears 44 and a chain 45 winding around the two gears 44. The sliding base 21 is connected with the chain 45. A motor (not shown) drives one of the gears 44, which in turn drives chain 45 to move the sliding base 21 along the track 13. This example shows that the scope of the invention is not limited by the type of the transmission mechanism 41. Any transmission means that can drive the sliding base to move along the track 13 in a straight line should be viewed as an equivalent of the disclosed embodiments.

According to the above description, the invention has the following advantages:

1. The shell 11 is integrally formed by aluminum extrusion to have a track structure 13 on its internal surrounding surface and extending along a straight line. This makes further machining easy and reduces the production cost.

2. The sliding base 21 has wheels to slide on the surrounding surfaces of the track 13 of the shell 11. Each of the wheels 26 firmly slide on the top and bottom surfaces of the track 13 due to the urging of the elastic urging elements 27. Even if there is less precision in the production of the track 13, the elastic urging elements 27 can still make sure that the wheels 26 of the sliding base 21 slide on the top and bottom surfaces of the track 13, thus ensuring the smoothness of the sliding.

3. The shell 11 is integrally formed by aluminum extrusion to have a track structure 13 on its internal surrounding surface and extending along a straight line. The sliding base 21 slides therein. Thus, there is no need to have guiding rails in parallel on both sides of the sliding base 21. This effectively reduces the size of the stringing device.

4. The sliding base 21 has wheels 26 to slide on the surrounding surfaces of the track 13 of the shell 11, and the wheels 26 firmly slide on the track 13 due to the urging of the elastic urging elements 27. The elastic urging elements 27 can absorb possible deviations between the sliding base 21 and the guiding screw bar 43. Therefore, the guiding screw bar 43 is less likely to bend or deform and has a longer lifetime.

5. To assemble the invention, one only needs to directly insert the sliding base 21 into the track 13. The urging effect of the elastic urging elements 27 makes the wheels 26 automatically touch against the top and bottom surfaces of the track 13, without additional calibration. Therefore, the invention has less precision requirement, making the assembly fairly easy.

6. The scratching boards 28 are provided around the wheels 26 opposite in the horizontal direction. When the sliding base 21 is driven by the transmission mechanism 41 to move in a straight line, the urging section 281 of each of the scratching boards 28 can remove dusts on the top surface and the bottom surface of the track. This action further ensures the smoothness of the motion of the sliding base on the track 13.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A string device of a racket stringing machine, comprising:

a hollow shell with a track extending along a straight line on the inner surrounding surface thereof;

a sliding base accommodated in the track of the shell, with wheels on the opposite sides thereof to slide on the surrounding surfaces of the track;

a stringing head extended downward with a strain gauge whose bottom end is fixed on the sliding base, exposing the stringing head from the top surface of the shell; and a transmission mechanism connected with the sliding base for driving the sliding base to slide along the track, thereby concurrently driving the stringing head on the sliding base to move along a straight line.

2. The string device of a racket stringing machine according to claim 1, wherein the top surface of the shell has a long groove extending along a straight line, each side of the longitudinal direction of the long groove is protruded upward with an engaging groove, and a sliding cover is disposed in the engaging groove to slide therein.

3. The string device of a racket stringing machine according to claim 1, wherein the lower part of the shell opposite to the track is further extended with an accommodating space in connection with the track.

4. The string device of a racket stringing machine according to claim 1, wherein the four corners of the side surface of the sliding base are formed with a through hole, respectively; each of the through holes is inserted with a wheel axis whose outer diameter is slightly smaller than the diameter of the through hole; both ends of each of the wheels exposed from the through holes are connected with a wheel, respectively; two elastic urging elements are interposed between the two wheel axes opposite in the vertical direction; and the two elastic urging elements urge both ends of the corresponding wheel axes near the wheels, so that the wheels opposite in the vertical direction slide on the top and bottom surfaces of the track.

5. The string device of a racket stringing machine according to claim 4, wherein two side surfaces of the sliding base having the wheels are provided with scratching boards in the upper and lower parts, respectively; each of the scratching boards is disposed around the opposite wheels in the horizontal direction; both ends of each of the scratching boards are extended toward the opposite surrounding surface of the track with an urging section, respectively; an elastic element is disposed between the two scratching boards on the same side surface of the sliding base; and the elastic element urges the urging sections of the two scratching boards to touch the top and bottom surfaces of the track.

6. The string device of a racket stringing machine according to claim 1, wherein a screw connection element is provided inside the sliding base; the transmission mechanism consists of a motor and a guiding screw bar driven by the motor; the guiding screw bar is connected to the screw connection element inside the sliding base; and the sliding base is driven by the guiding screw bar and restricted by the track to move in a straight line along the track when the motor drives the guiding screw bar.

7. The string device of a racket stringing machine according to claim 1, wherein the two ends of the predetermined sliding stroke of the sliding base on the shell are provided with a reed switch, respectively; two control units for starting the corresponding reed switches are provided at predetermined positions; and a reverse signal is transmitted to the transmission mechanism when the reed switches are started so that the sliding base performs a reciprocal linear motion between the two ends of the predetermined sliding stroke.

8. The string device of a racket stringing machine according to claim 1, wherein the transmission mechanism consists of two gears and a chain winding around the two gears, the sliding base is connected with the chain, and a motor drives one of the gears so that the chain is pulled to move the sliding base in a straight line.

* * * * *